United States Patent [19]

Ellison et al.

[11] 4,140,467

[45] Feb. 20, 1979

[54] CONVECTION OVEN AND METHOD OF DRYING SOLVENTS

[76] Inventors: Kenneth Ellison, 20 Avondale Crescent, Markham; Alan S. Whike, R.R. #1, Caledon East, both of Ontario, Canada

[21] Appl. No.: 732,165

[22] Filed: Oct. 13, 1976

Related U.S. Application Data

[63] Continuation-in-part of Ser. No. 585,198, Jun. 9, 1975, abandoned.

[51] Int. Cl.[2] ..... F23J 15/00; F27B 9/28

[52] U.S. Cl. ..... 432/72; 432/59; 110/204

[58] Field of Search ..... 432/8, 29, 59, 72, 128, 432/142, 152, 222; 34/18, 23, 35, 26, 40, 86, 155, 209, 210, 212, 218, 219, 223, 224, 227, 72; 110/204

[56] References Cited

U.S. PATENT DOCUMENTS

| | | | |
|---|---|---|---|
| 1,606,390 | 11/1926 | Schmuck | 432/222 |
| 2,107,275 | 2/1938 | Anderson et al. | 34/23 |
| 2,743,529 | 5/1956 | Hayes | 34/35 |
| 2,750,680 | 6/1956 | Houdry et al. | 432/8 |
| 2,795,054 | 6/1957 | Bowen | 432/8 |
| 3,186,698 | 6/1965 | Thome | 432/152 |
| 3,623,235 | 11/1971 | Smith, Jr. | 34/86 |
| 3,905,126 | 9/1975 | Villalobos et al. | 34/72 |
| 3,917,444 | 11/1975 | Carthew | 432/72 |
| 3,923,449 | 12/1975 | Brock | 432/59 |

*Primary Examiner*—Henry C. Yuen

[57] ABSTRACT

A method of heat treating a workpiece, and an oven for carrying out the method in which, the gaseous atmosphere within each zone is continuously recirculated by recirculating fan and duct systems within each zone, and directed onto the workpiece, thereby losing heat to the workpiece, and coating thereon. A substantial proportion of the oven atmosphere containing solvent vapors is continuously passed through individual zone incinerators located within each of the oven zones, thereby oxidizing the solvent vapor content of such portion. The incinerated proportion of gases is then re-mixed with the untreated gaseous atmosphere prior to entry to the recirculating fan and duct system thereby re-heating the gaseous atmosphere to a controlled elevated temperature. Sufficient incinerated oxidized gas volume is recycled as ventilation in each zone to maintain a predetermined desired zone gas temperature and at the same time incinerate as much as possible of the solvent vapor content, thereby releasing the heat content of the solvent, without producing an excessive temperature rise. This clean recycled gas thus reduces the need for fresh air for oven ventilating purposes.

In one embodiment a further portion of the oven effluent containing solvent vapors, passes through a bypass incinerator and the oxidized gases then enter a radiant heating system which is in turn transmitted as radiant heat directly to the strip. The oxidized gases are then discharged from the radiant heater into the oven, providing additional ventilation.

15 Claims, 9 Drawing Figures

CONVECTION OVEN AND METHOD OF DRYING SOLVENTS

This application is a Continuation-In-Part of application Ser. No. 585,198, filed June 9, 1975, entitled "Convection Oven and Method of Drying Solvents" now abandoned.

The present invention relates to ovens for drying or curing coatings such as paints, adhesives containing oxidizable solvents and the like applied to a workpiece moving through such oven, such as for example strip material.

The oven under consideration is generally known in the trade as a "recirculating convection oven".

Such ovens are usually divided into oven zones. In each zone recirculating fans and ducts are provided to continuously recirculate the zone atmosphere and produce gas flow around the workpiece. Such gases are heated during recirculation to maintain oven temperature. A proportion of such gases is continuously withdrawn as "effluent", and replaced with make up air or gases.

The curing of coatings containing solvents, such as those applied to strip sheet metal, presents a number of problems. In the first place, the solvent fumes must be rendered harmless before venting to atmosphere so as to avoid environmental pollution. This can be done in some cases by solvent extraction, condensing the solvent vapours from the effluent from the oven for reuse or by use of a catalyst such as platinum. However, in the majority of cases the solvent vapours are simply oxidized by passing the effluent through an incinerator chamber which in most cases must be capable of operation at a solvent oxidation level of 98% to 99% in order to meet prevailing standards for emissions from this type of equipment. Usually such incinerators are gas fired incinerators, and the fuel consumption required in order to operate at these levels of efficiency with the very large volumes of oven effluent is a major consideration in the design of such an oven.

Recovery of the heat generated by such incinerators for use in the oven, or for use elsewhere will somewhat reduce the operating cost of the incinerator, but in many cases it is not possible to use the heat recovered from the incinerator in an economical manner, or to its full extent.

It is therefore desirable where possible to reduce the volume of emissions to atmosphere, and thereby reduce the size of the incinerator for treating such emissions. Proposals have been made for continuously recycling oxidized gases from the exhaust incinerator, and returning them within the system, so as to reduce the volume of exhaust going to atmosphere, but this is of only limited value, and leaves large volumes of oxidized gases which cannot be used in the oven due to temperature control limitations required for individual zones in the oven. Since any exhaust volume must be replaced by fresh air, which must eventually be heated to incineration temperature, an unnecessary heat load is incurred.

A second major factor in the construction of such ovens is the manner in which the various zones in the oven are heated. Various different heating systems have been used, a common system being the use of gas burners heating the recirculating gases in the various zones. Clearly, the fuel cost for heating such gases is a further major factor in the cost of operating the oven. Some systems have been proposed for reducing the fuel requirement for heating the gases in the various zones by recycling the oxidized gases exiting from the incinerator back through the zones, and such systems have met with some degree of success. However, they introduce further problems. In particular, the gases exiting from a typical incinerator will be at about 1,400° F. At these temperatures, conventional steel duct work, fans, dampers, and the like are no longer usable, and special alloys must be employed to withstand such temperatures. This of course greatly increases the construction costs of the oven and requires more frequent maintenance, and reduces reliability.

A further major factor in the design of such ovens is the ability to control the temperature of the gases in the various zones, and to regulate the gas temperatures in the different zones progressively so that the coating on the strip is cured in the most advantageous manner. Such coatings may employ several different solvents having different boiling points so that the coating dries progressively from the inside out to produce the desired finish. Similarly, some types of paints have solvents with relatively high boiling points therefore requiring relatively high temperatures in the oven, and other forms of coatings, such as some adhesives use solvents with relatively low boiling points requiring lower temperatures.

Accordingly, in order to build an oven which is capable of handling a wide range of different paints, coatings, adhesives and the like over a relatively wide range of temperatures, it is essential that the gas temperatures in the various zones may be closely regulated and controlled. The controlling of gas temperature in the different zones of an oven, where the gases are heated even partially by means of recycled incinerator gases at high temperatures, becomes particularly difficult, since the regulation of the temperature will depend upon the proportioning of a mixture of fresh air, and incinerator gases introduced into each zone, so as to produce the correct gas temperature within the zone. As mentioned above, the handling of incinerator gases at the high temperatures experienced, is both difficult and relatively expensive in terms of the equipment required and these factors still further mitigate against the use of recycled incinerated gases for maintaining the gas temperature in each of the oven zones.

A further factor in the design of such curing ovens is that for safety reasons it is essential that the solvent vapour content of any effluent in the oven duct work shall be at or below a desired percentage of the lower explosive limit (the so-called L.E.L) for any particular solvent. Normally, this is achieved by ensuring that the make up gases entering the zones contain negligible amounts of solvent vapours, and maintain a sufficient level of ventilation in the zone. If an unusual situation should arise and excess solvent vapours should become entrained with the gases and the solvent limit is exceeded, then emergency measures must be taken to vent the oven and reduce the solvent vapour content of the gases present in the system to avoid the danger of an explosion. Obviously, if such emergency measures have to be taken at all frequently, then the operation of the system is not commercially sound since each time the system is shut down, there will be considerable wastage of product and machine down-time.

It is however desirable that in any such an oven system provision should be made for rapid venting and cooling of the system, with a minimum of disruption to the operation of the coating line, so as to permit rapid change-overs from one colour to another for example, and at the same time providing for emergency venting of the system if the solvent limit is inadvertently exceeded. Earlier oven systems did not generally speaking have this flexibility combined with the safety features mentioned, and relatively lengthy proceedures were necessary to effect a change-over of colour for example.

In addition to convection heating of the strip by recirculating hot gases, it is also desirable at some point in the curing line to provide for radiant heating of the strip so as to actually heat up the strip metal itself and thereby cure the paint or other coating material from the inside to the outside of the coating layer. In the past, such radiant heating was usually effected, if at all, by means of gas radiants or by means of electrical radiants located within the oven. Such radiant heating systems involved the use of still further fuel input adding still further to the cost of the operation of the system.

BRIEF SUMMARY OF THE INVENTION

It is therefore a general objective of the present invention to provide an oven and method of treating a workpiece of the type described in which the various disadvantages and inefficiencies of earlier oven systems are eliminated or at least reduced. The gaseous atmosphere within each zone is continuously recirculated by recirculating fan and duct systems within each zone, and directed onto the workpiece, thereby losing heat to the workpiece, and coating thereon. A substantial proportion of the oven zone atmosphere containing solvent vapours is continuously passed through individual zone incinerators located within each of the oven zones, thereby oxidizing the solvent vapour content of such portion. The incinerated proportion of gases is then re-mixed with the untreated gaseous atmosphere prior to entry to the recirculating fan and duct system thereby re-heating the gaseous atmosphere to a controlled elevated temperature. Sufficient incinerated oxidized gas volume is recycled as ventilation in each zone to maintain a predetermined desired zone gas temperature and at the same time incinerate as much as possible of the solvent vapour content, thereby releasing the heat content of the solvent, without producing an excessive temperature rise. This clean recycled gas thus reduces the need for fresh air for oven ventilating purposes.

A proportion of oven atmosphere is continuously removed from the oven as exhaust gases and a further incinerator is provided in the exhaust system for the oven, through which the oven exhaust is passed, to permit venting to exterior ambient atmosphere, the exhaust incinerator oxidizing the solvent vapour content to avoid environmental damage. Fresh air is admitted sufficient to make up losses of oven atmosphere vented to exhaust.

Frequently, where several zones are employed, the first zone will be at a lower temperature, and will produce a high rate of release of solvent vapour. Second and subsequent zones will typically operate at higher temperatures, and produce lower rates of solvent release.

In one particular type of oven in accordance with this invention, a proportion of the zone atmosphere from the first zone is preferably passed down within suitable ductwork within the oven to a subsequent such zone where it is incinerated and added to the recirculating fan system in the subsequent zone. Similarly a proportion of the zone atmosphere in a subsequent zone is passed back up the oven to a preceding (eg. the first) zone where it may be incinerated and added to the recirculating fan system in such preceding zone.

In one or more of the zones in such a multi-zone oven, however, a proportion of the zone atmosphere of a zone may simply be incinerated in that zone and returned to the recirculating fan system in that zone.

In the multi-zone oven, oven exhaust will be drawn off for incineration and venting as required to maintain safe limits of solvent vapour content, usually from eg. the first zone, or between the first and second zones, and a similar volume of fresh air, which may or may not be preheated, will be admitted in the first zone.

In this way moderate temperatures and high solvent content can be accurately maintained in the zones of highest solvent release, and in the subsequent zones of lower solvent release, higher temperatures can be maintained largely on the fuel content of the solvent released in the preceding zones, together with the fuel requirements of the incinerators themselves.

In one modification of the invention, a portion of the oven atmosphere containing solvent vapours, passes through an incinerator and the oxidized gases then enter a radiant heating duct system and provide heat input which is transmitted as radiant heat directly to the workpiece. The oxidized gases are then returned from the radiant heating system into the oven recirculating fan system and form part of the oven atmosphere.

In one modification the invention may provide for the effluent from one or more low solvent release zones having a low solvent content, to be reintroduced directly into a high solvent release zone, whereby to increase the ventilation of such zone, without further incineration.

In another modification of the invention, the individual oven zones may be provided both with individual zone incinerators for oxidizing oven atmosphere in the zones, and in addition, may be provided with supplementary heaters, for providing a rapid warm up of the various zones, and providing supplementary heat if required.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A PREFERRED EMBODIMENT

Figure 1:
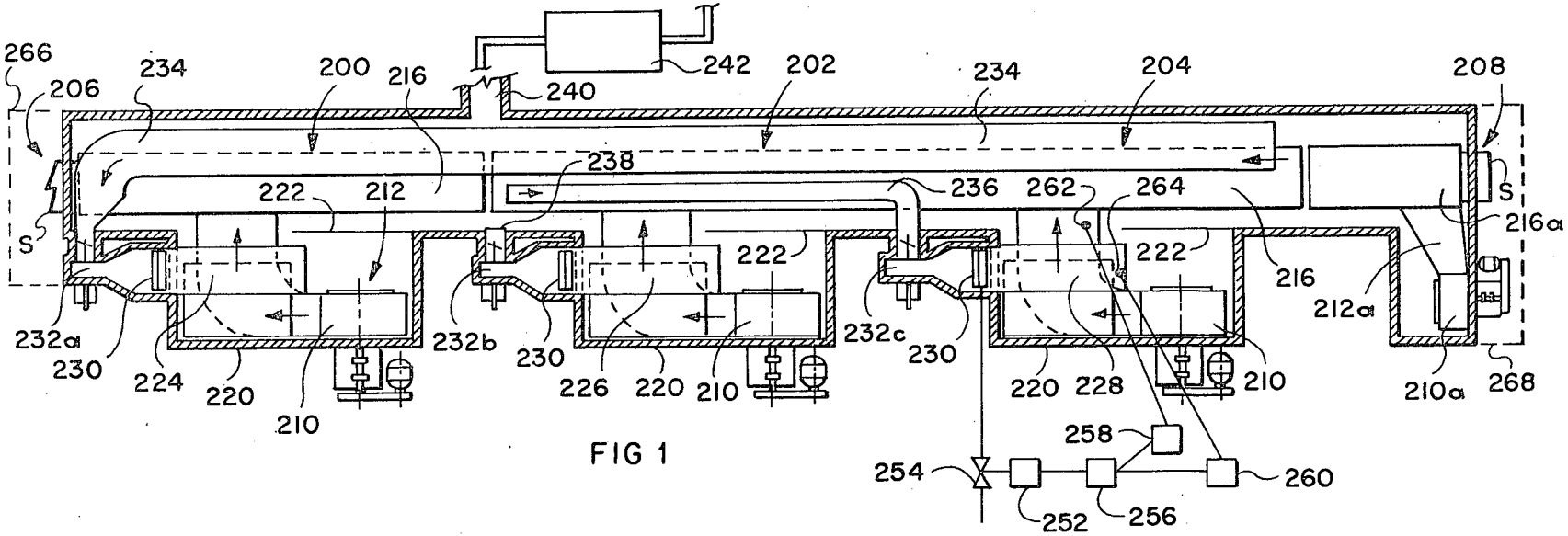
FIG. 1 is a sectional top plan view of a strip treatment oven in accordance with the invention.
Figure 2:
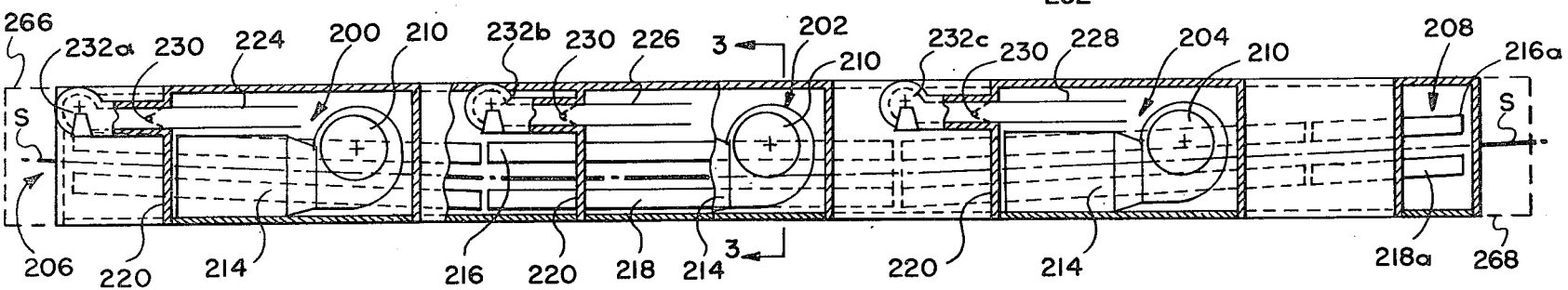
FIG. 2 is a partially sectioned side elevation of the oven of FIG. 1.
Figure 3:
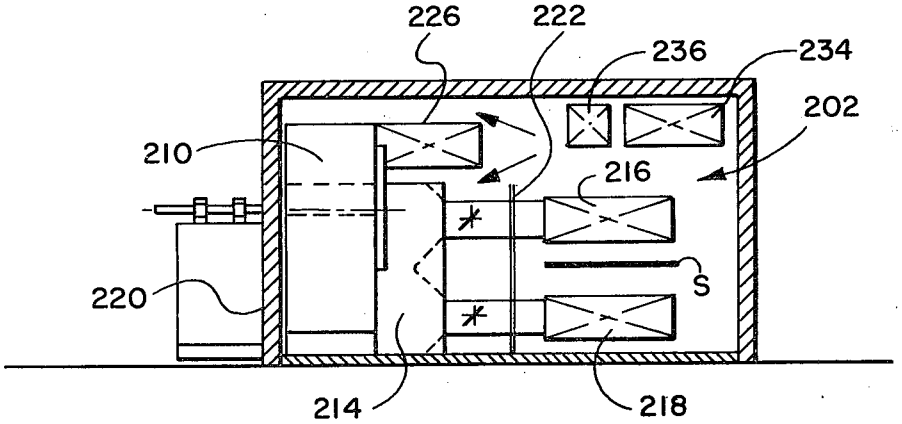
FIG. 3 is a partially sectioned view along the line 3—3 of FIG. 2.

Referring first of all to FIGS. 1, 2 and 3, the invention is there shown in the form of an oven for curing coatings applied to strip sheet metal. The oven comprises three oven zones indicated as 200, 202 and 204, respectively.

An inlet end 206 and an outlet end 208 form the two ends of the oven.

The oven zones are not separated from one another, but in fact are all contained within a single integral housing which is continuous from one end of the oven to the other.

The zone 200 comprises the lower temperature high solvent release zone, and the zones 202 and 204 will be respectively at somewhat higher temperatures, with the volume of solvent release progressively decreasing. Within each of the zones 200, 202 and 204 a separate fan and duct recirculating system is provided for continuously recirculating the atmosphere within that zone and redirecting onto the strip shown as S in FIG. 2. Each of the zones is thus provided with a fan 210 having an intake 212 and an outlet duct 214. The outlet duct 214 in turn supplies upper and lower discharge ducts 216 and 218. These ducts 216 and 218 run lengthwise along the zones 200, 202 and 204 respectively thereby to provide continuous discharge of zone atmosphere onto both the upper and lower surfaces of the strip S simultaneously along substantially its entire length as it passes through each of the zones. Fans 210 are driven by separate power sources such as electric motors or the like. The upper and lower discharge ducts 216 and 218 will usually be provided with suitable dampers or the like. Preferably, the fan 210 and the outlet ducts 214 are all located in a small chamber indicated as 220 formed at one side of each of the zones 200, 202 and 204 respectively. An air flow baffle 222 is disposed between the intake of each fan 210 and the interior of a respective one of the zones 200, 202 and 204 to avoid undesireable air flow patterns within the zones. Each of the zones 200, 202 and 204 respectively are provided with incinerator flame tubes 224, 226 and 228 respectively. The flame tubes are in turn supplied internally with incinerator burners 230 which are typically fired by natural gas, or other suitable fuel.

Fans 232*a*, 232*b* and 232*c* are provided for forcing portions of zone atmosphere through the flame tubes 224, 226 and 228 respectively.

In order to supply zone atmosphere to the incinerator tube 224, a zone atmosphere transfer duct 234 is provided extending down the length of the interior of the oven from the upstream end of the tube 224, in zone 200, and having its free open end at the downstream end of the zone 204. In this way, the fan 232*a* supplying the tube 224 will draw zone atmosphere from the downstream end of the zone 204, and will pass it all of the way up the oven, through zones 202 and 200 and supply it to the flame tube 224.

Supply for the flame tube 228 is provided by the oven atmosphere transfer duct 236, communicating between the fan 232*c* and a point midway between zones 200 and 202. In this way, zone atmosphere will be drawn from the transition between zone 200 and 202 supplied to the flame tube 228.

The flame tube 226 of the zone 202 is supplied through port 238, communicating with the fan 232*b*. The port 238 draws zone atmosphere from about the same point as the transfer duct 236. In this way, zone atmosphere is withdrawn simultaneously by both the fans 232*b* and 232*c* from about the same point ie., the transition between zone 200 and 202.

The outlets of the respective incinerator flame tubes 224, 226 and 228 are located more or less adjacent the intakes 212 of the fans 210 in the zones 200, 202 and 204 respectively. In this way, incinerator gases exiting from the tubes 224, 226 and 228 respectively will mix with oven atmosphere gases before being drawn into the intakes 212 of the fans 210 thereby modifying the temperature of both gases, and achieving the two desirable objectives namely raising the temperature of the oven atmosphere as a whole, while reducing the temperature of the incinerator gases themselves thereby overcoming problems caused by the handling of high temperature incinerator gases.

This significant advantage is achieved at least in part by the location of the flame tubes 224, 226 and 228 essentially within the zones 200, 202 and 204 respectively where they are surrounded by the zone atmosphere which is already at an elevated temperature and in a state of considerable turbulence caused by the rapid high volume circulation of the oven atmosphere induced by the fans 210. In this way, as soon as the high temperature incinerator gases are discharged from the incinerator flame tubes they are immediately mixed with the surrounding oven atmosphere which is at a considerably lower temperature without the need for providing costly high temperature ductwork and control dampers.

In order to admit oxygen for combustion, and control the L.E.L. of the oven atmosphere, a certain volume of the oven atmosphere must be withdrawn and a certain volume of fresh air introduced into the oven continuously. An exhaust stack 240 is therefore provided, which will communicate with a further incinerator 242 where the exhaust gases are incinerated to oxidize the solvent vapour content prior to venting such incinerated exhaust gases to the surrounding ambient atmosphere. If desired, some form of heat recovery can be incorporated in the exhaust stack, downstream of the incinerator 242 to recover some of the heat. Possibly, such heat recovery system may be used to preheat incoming fresh air although in the majority of cases this will not be necessary and the heat recovery system will merely provide for example steam for heating the building.

Admission of fresh air in volumes essentially equal to the volume of oven atmosphere exhausted through the stack 240 may be provided in various ways. Where only limited volumes of fresh air are required then it can enter simply through either end of the oven, i.e., through the strip entry 206 and the strip exit 208. In this way, the air flow pattern within the oven will always be inward with respect to either end thereby substantially completely preventing the escape of oven atmosphere through the open end of the oven with consequent pollution of the atmosphere within the buildings surrounding the oven.

However where larger volumes of fresh air are required, due to larger volumes of exhaust gases being exhausted up the stack, then fresh air inlets (not shown) may be provided.

Adjacent the strip exit 208, there may be provided an additional circulating fan 210*a*, and ductwork 212*a* and 216*a* and 218*a*, for maintaining continuous circulation of the zone atmosphere at the exit end. In the majority of cases the zone atmosphere at this point will not require the provision of a further zone incinerator, and consequently none is illustrated in the embodiment of FIGS. 1 and 2.

Figure 4:
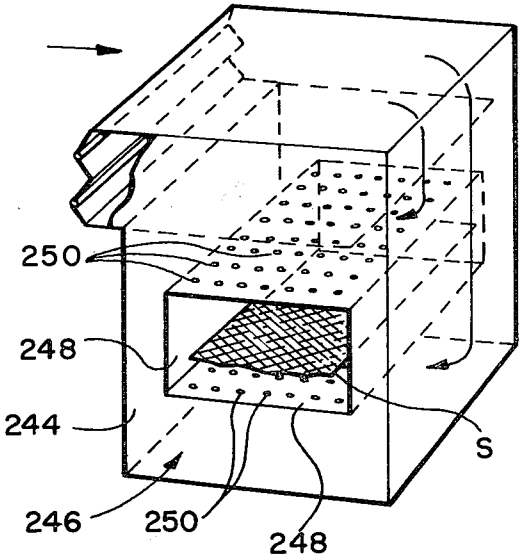
FIG. 4 is a schematic perspective illustration partially cut-away of an alternate embodiment.

In some circumstances it may be desirable to provide for additional direct heat input to the strip. This may be achieved by radiant heating by means of the additional radiant heater as shown in FIG. 4. FIG. 4 illustrates a radiant heating unit in the form of a generally square box-like duct 244 having a rectangular opening 246 therethrough for passage of the strip S therethrough.

The box-like duct 244 is connected to for example the incinerator flame tube 228 for receiving the high temperature incinerator gases directly therefrom through suitable high temperature ductwork (not shown).

The high temperature incinerator gases will flow through the duct 244.

Within the duct 244, four rectangular wall members 248 are provided, providing an open ended passageway extending through the duct 244, communicating with the openings 246 through which the strip S passes.

In the upper and lower walls 248, gas outlet holes 250 may be provided, through which jets of high temperature incinerator gases may pass downwardly and upwardly and impinge directly on the upper and lower surfaces of the strip S.

In addition, the four wall surfaces 248 will be heated to an elevated temperature by the high temperature incinerator gases, and will thus subject the strip S to radiant heat, as well as heating by the action of the impingement of the gases themselves.

The radiant heater duct may be provided with, or without, the holes 250, depending on its location in the oven. Where no such holes 250 are provided, then the only heating effect will be a radiant heating effect. In this case it will usually be located in the first, high solvent release zone 200, and will heat the strip sheet metal itself, without heating the coating to the same extent. The coating will then tend to cure from the inside outwardly.

Where additional heat input is required in for example zone 202, having a higher temperature and lower solvent release, then the provision of holes 250 is acceptable since the coating is already partially cured and can withstand the impingement of the high temperature gases.

In accordance with the invention, a novel form of fuel control is provided for the incinerators 230. Each of them is provided with a separate fuel control 252 which will typically be an electrical type control, possibly in the form of a synchronous motor, operating a fuel supply valve 254.

The motor 252 is in turn operated by a relay 256. The relay 256 is in turn connected with two temperature responsive signal generators 258 and 260.

Signal generator 258 is connected with a temperature sensor 262, and signal generator 260 is connected with a temperature sensor 264. The signal generators 258 and 260 are responsive to predetermined high and low temperatures to operate the motor 252 so as to supply either less or more fuel to the burner 230.

The burners 230 are thus responsive to (a) variations in the temperature of their own output and to (b) variations in the temperature of the oven atmosphere.

In this way, each of the burners 230 is solely responsible for maintaining a predetermined temperature level in its respective zone of the oven.

It will be appreciated that while only one such system of temperature control is illustrated for one of the burners 230, the same system of controls is provided in fact for each of the burners.

Air doors 266 and 268 are provided at the entry and exit to the oven chamber, and prevent the escape of oven atmosphere at these points.

Figure 5:
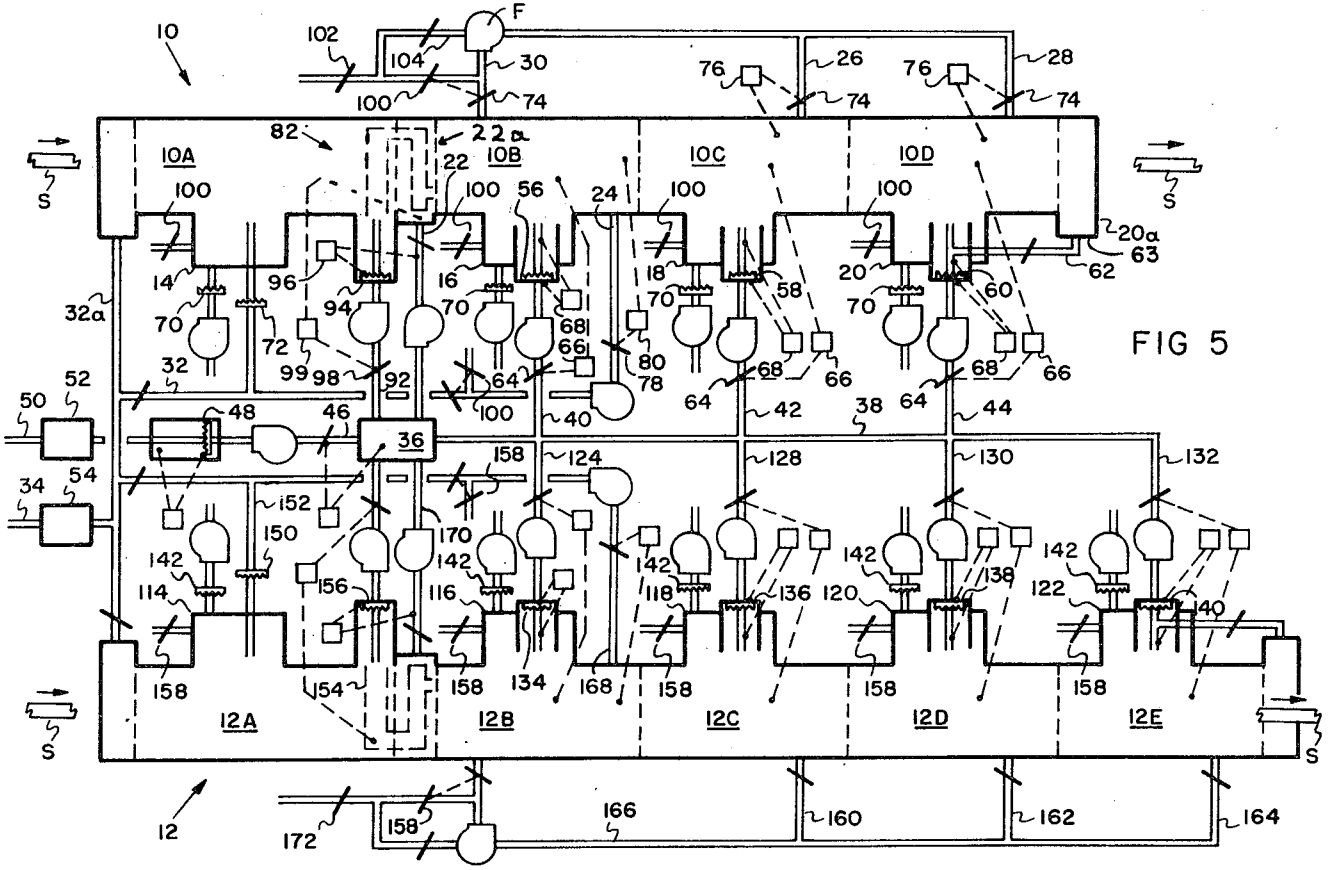
FIG. 5 is a schematic illustration showing the layout of a more complex form of curing oven system according to the invention in which provision is made for simultaneous curing of a strip having a prime coat, and a further strip having a finish coat.
Figure 6:
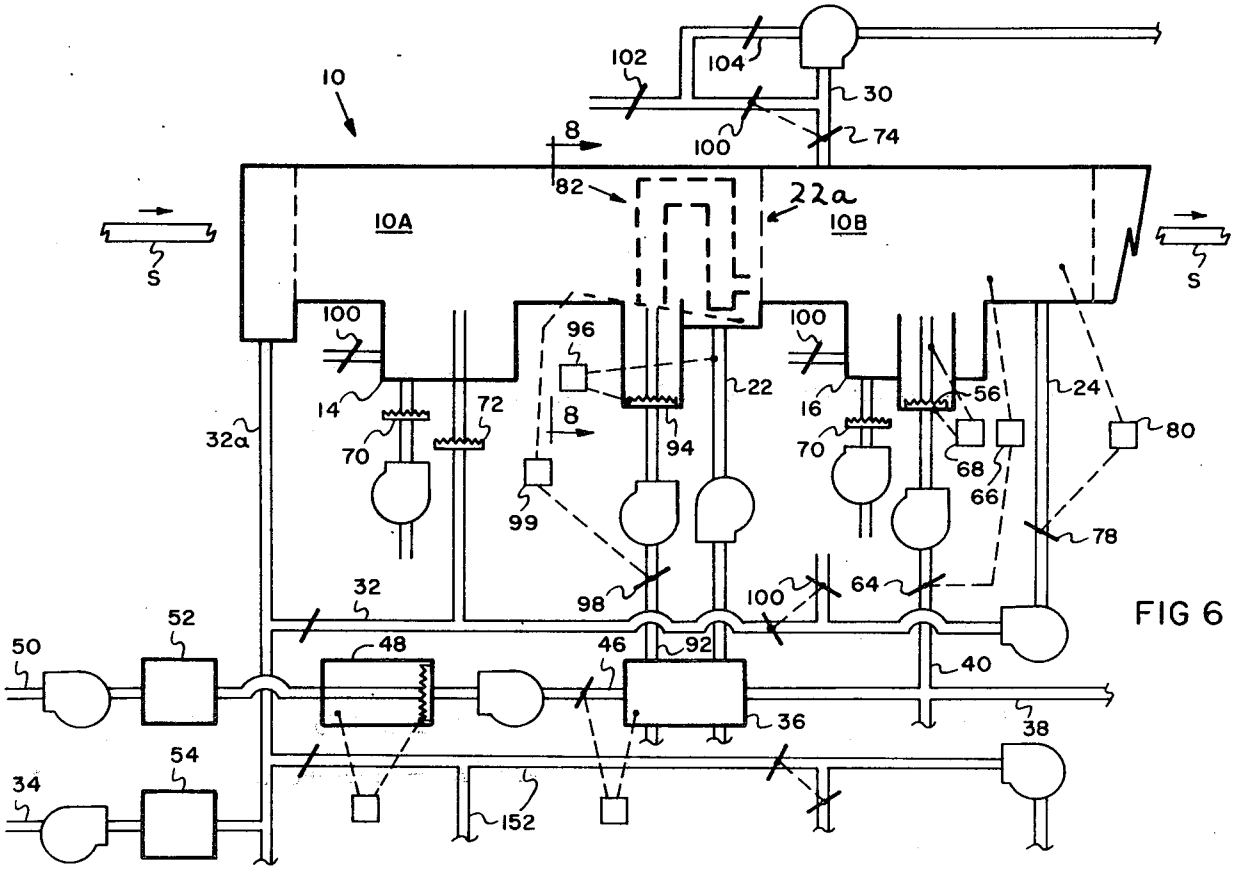
FIG. 6 is an enlarged illustration showing one-half of the oven system shown in FIG. 5, in greater detail.
Figure 7:
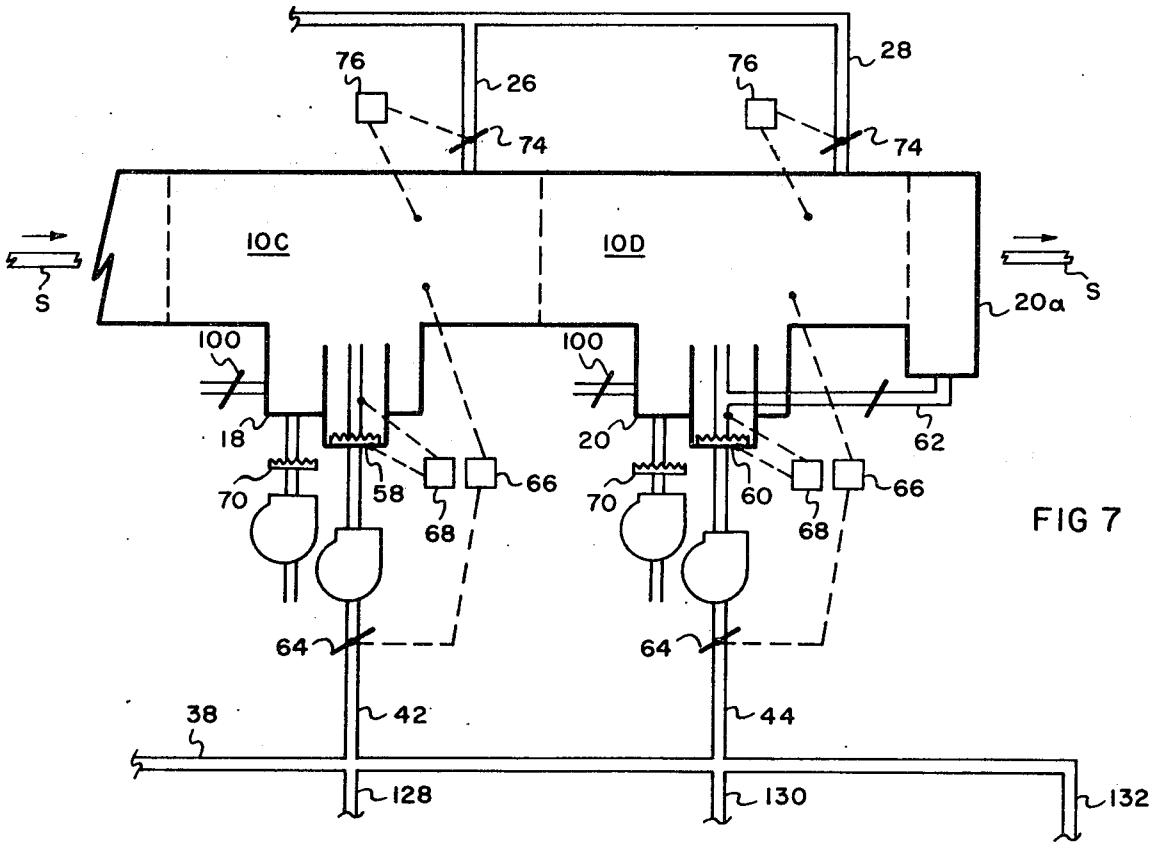
FIG. 7 is an enlarged illustration showing the other half of the oven system shown in FIG. 5 in greater detail.

Referring now to FIG. 5, this illustration shows in schematic form the layout of a more complex oven installation suitable for use where strip sheet metal is painted, or coated with a prime coat and then a finish coat. Obviously however, oven installations of the same general type will be suitable for other purposes such as the curing of other forms of coatings, and the curing of adhesives, with only minor modifications as will suggest themselves to persons skilled in the art.

As shown in FIG. 5, the oven installation comprises a prime coat oven 10 and a finish coat oven 12, which are separate from one another, but are interconnected with the same ventilation and heating system, whereby they may be operated simultaneously, for curing two different strips at the same time.

The prime coating oven 10 will be seen to be divided nominally into four zones namely 10A, 10B, 10C and 10D. The finish coating oven will be seen to be nominally partitioned into five zones namely 12*a*, 12*b*, 12*c*, 12*d* and 12*e*.

The organization and arrangement of the ovens 10 and 12 is essentially the same, and accordingly detailed description will be given initially of oven 10, it being understood that the finish coating oven 12 is provided with essentially the same equipment, which will be described somewhat more briefly hereinafter.

The four zones 10A, 10B, 10C and 10D of oven 10 are all constructed as a single continuous unit essentially in the form of a tunnel or elongated chamber of suitable dimensions to accept passage of a strip of sheet metal or other strip workpiece, moving therethrough. Each of the oven zones 10A, 10B, 10C and 10D are provided with oven zone gas recirculation chambers 14, 16, 18 and 20, through which the zone gas or atmosphere is continuously recirculated into the zone in a manner known per se, by any suitable circulating fans and duct work, not shown.

Effluent gas is extracted from each of the oven zones through respective exhaust conduits 22, 24, 26 and 28. In order to increase the ventilation through zone 10B, the exhaust conduits 26 and 28 are united at conduit 30, which reintroduces the effluent from oven zones 10C and 10D back into oven zone 10B.

Oven zone 10A will receive fresh air input through fresh air conduit 32 which in turn will receive fresh air through the fresh air supply system 34. This fresh air supply system 34 may be connected so as to receive fresh air from the atmosphere. Alternatively however and in the preferred case, it will in fact be connected to the air ventilation and exhaust system for the coater rooms, where the strip is coated. In this way, the atmosphere of the coater rooms is kept fresh and breathable, and any solvent fumes which may evaporate within the coater room will be contained and used within the oven system, so that the heat available from the solvent vapours may be used in the ovens, and will not be simply vented to atmosphere from the coater rooms themselves. This system also avoids the requirement for attaching an incinerator to the coater room ventilation system which might otherwise be necessary in certain jurisdictions to avoid environmental pollution. A branch fresh air duct 32*a* may be connected to the entrance to the oven zone 10A so as to pass fresh air directly into the opening at the front of the oven zone 10A.

The exhaust conduit 22 is located at the main oven exhaust section 22*a* in zone 10A and is connected to a central mixing chamber or plenum 36. From the plenum 36 a main supply duct 38 connects with branch supply ducts 40, 42 and 44 respectively. The branch ducts 40, 42 and 44 in turn are connected with the zone recirculation chambers 16, 18 and 20 of the oven zones 10B, 10C and 10D.

The plenum 36 also connects with the exhaust duct 46, feeding the exhaust incinerator 48 which is then directed to the exhaust stack 50. A heat recovery system 52 may be provided on the output to the incinerator 48, and the heat recovered may be used for any heating purpose around the plant, and may also be used for preheating the incoming air on the air supply system 34 by means for example of the air preheater 54.

It will be understood that the plenum 36 will be receiving oven effluents which are essentially the combined effluent output of zones 10D, 10C, 10B and 10A.

In accordance with the invention, some of the vapours in the effluents going to the plenum 36 are utilized for heating the zones 10B, 10C and 10D. In order to achieve this purpose, each of the zones 10B 10C and 10D respectively is provided with its own incinerator 56, 58 and 60 respectively. Each of the incinerators 56, 58 and 60 is supplied with oven effluent carrying solvent fumes, by means of the branch ducts 40, 42 and 44. The incinerators function to oxidize the solvent vapours, and the high temperature oxidized gases are then mixed with the recirculating zone gases entering the oven zones through the respective zone recirculating chambers 16, 18 and 20 and at the same time reducing the percentage of solvent vapours in such recirculating zone gases. A branch input duct 62 communicates with air curtain at 30*a* of oven zone 10D to supply hot gases to the exit end of the zone 10D.

In order to control the temperature within each of the zones 10B, 10C and 10D control dampers 64 are located in the ducts 40, 42 and 44, and are controlled by suitable temperature controls 66, connected to suitable temperature sensors (not shown) located within the respective zones 10B, 10C and 10D. Variation in the zone temperature due to varying heat load will produce variation in the volumes of oven effluent gas supplied to the incinerators, by operation of the dampers 64, thereby varying the flow of hot oxidized gases from the respective incinerators 56, 58 and 60. In this way, the temperature of each zone can be regulated to a desired preset level.

In accordance with well known practice in the art, the incinerators 56, 58 and 60 will be fired normally by natural gas or other suitable fuel, more or less being required dependent upon the percentage of solvent vapour content in the gas supplied through the ducts 40, 42 and 44. In order to control the temperature of the oxidized gas from the incinerators 56, 58 and 60, suitable temperature controls 68 are provided, and connected to sensors (not shown) for sensing the temperatures of the gases exiting from the respective incinerators, thereby controlling the fuel input.

In order to provide for a rapid warmup of the oven zones 10A, 10B, 10C and 10D, supplementary heaters 70 are provided for the respective recirculation chambers. It will of course be appreciated that such supplementary heaters will be used mainly during the initial start-up phase of operation, and that in the great majority of cases, once the gases in the ducts 40, 42 and 44 are carrying their regular volumes of solvent vapours, the operation of the individual incinerators 56, 58 and 60, will be sufficient to provide all the heat required for the zones 10B, 10C and 10D and the heaters 70 will remain on low fire or will be shut down. Such supplementary heaters will usually be fired by natural gas for example although any other suitable fuel, capable of providing adequate heat at the location may be substituted. Any suitable control may be provided, the details of which are omitted for the sake of clarity.

A heater 72 is provided on the air conduit 32 for heating the combined incoming fresh air and effluent gases entering the zone 10A of the oven. Heater 72 is not an incinerator and does not oxidize the solvent vapours in the effluent gases at this point.

In order to regulate the flow of exhaust gases out of the zones 10C and 10D, dampers 74 are provided in the exhaust conduits 26 and 28, and pressure sensitive control means 76 are provided for sensing the pressure in the zones 10C and 10D, and varying the position of the dampers 74 accordingly. Similarly, the exhaust conduit 24 is also provided with a control damper 78, and pressure sensing means 80 for sensing the pressure in the zone 10B and varying the opening of the damper 78 accordingly. A damper 74 is also provided in the conduit 30.

Figure 8:
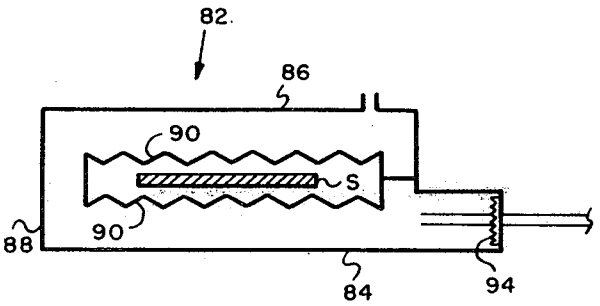
FIG. 8 is an enlarged schematic elevational view showing the radiant heating means of the oven of FIG. 6, when viewed as indicated by the arrows 8—8 of that figure and, FIG. 9 is a schematic plan view showing an alternate form of the radiant heating means.

In order to provide for radiant heating of the strip, a radiant heating unit indicated generally as 82, and shown in greater detail in FIG. 8, is located between zone 10A and zone 10B. As shown in FIG. 8, the radiant heating unit 82 will be seen to comprise a generally U-shaped loop of duct work, having a lower portion 84 and an upper portion 86 and a return U-bend 88. The lower and upper portions are adapted to extend on the lower and upper sides of a strip or workpiece passing through the oven 10, and are spaced apart a suitable distance to accommodate any variation in the position of the strip during operation of the oven. The portions 84 and 86 of the duct work are provided with inwardly directed radiant surfaces 90, which are preferably formed, at least on the interior of the duct work, with any suitable heat exchange surface formation such as fins, ridges, or any other suitable formation. Insulation is provided elsewhere around the duct work, to retain heat therein.

Bypass supply duct 92 extends from the plenum 36 to bypass incinerator 94 which in turn discharges into one end of the radiant heating unit 82, which end may be either that of the lower portion 84 or the end of the upper portion 86. The other end of the unit 82 discharges into zone 10A at exhaust section 22*a* and the gases then enter exhaust conduit 22 which communicates with the plenum 36 are described above. The bypass incinerator 94 is located in the bypass supply duct 92 for oxidizing the solvent vapours entrained in gases coming from the plenum 36. Such bypass incinerator will normally be fired by natural gas, or any other suitable fuel. The temperature of the oxidized gas from the bypass incinerator 94 is controlled by means of a temperature sensitive controller 96 sensing the temperature of the gases exiting from the incinerator.

The duct work portions 84, 86 and 88 provides an elongated oxidation chamber ensuring a long dwell time for oxidation of solvent vapours. The bypass incinerator 94 can thus be operated at a somewhat lower temperature while still achieving efficient oxidation.

Supply of gases to the bypass incinerator 94, from the plenum 36, is controlled by means of the damper 98 and pressure sensitive controller 99, sensing the pressure in the interior of zone 10A of the oven.

In order to provide for rapid cooling, and rapid venting in an emergency situation, a series of quick cooling fresh air vents are provided throughout the oven system which will admit fresh air to the oven at a number of different locations. Such quick cool vents are indicated as 100 and consist essentially of dampers which may be opened or closed either manually on command, or automatically by any suitable emergency control. Typically, such emergency controls will comprise gas analyzers located at various points within the oven, and operable to give an alarm signal if the solvent vapour content should exceed the desired percentage of the L.E.L. for that particular solvent.

An additional sealing damper 102 is provided to backup the quick cool damper 100 so as to prevent any risk of a leak of the oven effluent gases from the conduit 26 to atmosphere at this point in the system.

A pressure relief duct 104 extends from a point between the damper 100 and the sealing damper 102, back to the 30, upstream side of a fan F feeding gases from the conduit 26 to the conduit 30 so that any leakage through the damper 100 can be recycled back into the conduit 30.

Throughout the system numerous fans are provided which are shown schematically, the function of which will be apparent to those skilled in the art, and essentially maintain flow of gases through the system.

The finish coat oven 12 is provided with essentially the same system of zone incinerators and recycling of zone exhaust, the respective zone recirculating chamber being shown as 114, 116, 118, 120 and 122, for zones 12A to 12E respectively. Similarly, branch supply ducts 124, 128, 130 and 132 communicate from the main supply duct 38 with the respective zone recirculating chambers 12B to 12E. Individual zone incinerators 134, 136, 138 and 140 provide for oxidation of the solvent vapours supplied to them through the branch ducts, and provide heat input for gas recirculating in their respective zones.

Controls similar to those shown in the case of oven 10 will of course be incorporated, the details being omitted for the sake of clarity.

Similar supplementary heaters 142 are provided for zones 12A to 12E. A heater 150 is provided on the inlet duct 152 for heating the combined incoming fresh air and effluent gases entering the zone 12A of the oven 12. Heater 150 is not an incinerator and does not oxidize the solvent vapours in the effluent at this point.

A radiant heating unit 154 is provided in the main exhaust section of zone 12A, similar to the radiant heating unit 82 and provided with a bypass incinerator 156 controlled in the same manner as bypass incinerator 94 of the radiant heating unit 82.

Similar quick cool ventilation is provided by means of ventilators 158. Effluent from the zones 12C, 12D and 12E exhausts through respective exhaust ducts 160, 162 and 164 all of which are controlled by dampers, as described in connection with zones 10C and 10D. A common return duct 166 feeds the effluent of zones 12C, 12D and 12E back into zone 12B.

The effluent exhaust from zone 12B is removed through duct 168, uniting with fresh air duct 152, for supplying a mixture of fresh air and oven effluent directly into zone 12A. Effluent from the main oven section in zone 12A is removed through duct 170 and flows back into the common plenum 36.

A similar sealing damper 172 is provided to back-up the quick cool vent 158 on duct 166.

During normal operation of this embodiment of the invention, ie., when a steady state has been achieved, the plenum 36 and duct 38 will normally contain oven effluent containing solvent vapours at or close to the desired lower explosive limit. These gases flow down the duct 38 and up to the branch ducts 40, 42 and 44. It will be course be understood that similar gases will also flow up the branch supply ducts 124, 128, 130 and 132. However, the operation of the oven 12 will not be described in detail for the sake of simplicity since it is essentially the same as the operation of oven 10, and takes place simultaneously.

As the effluent gases flow down the branch ducts, they pass through the incinerators 56, 58 and 60 where the solvent vapours are oxidized in known manner. The combustion of the solvent vapours, together with the heat input from the incinerator burners, raises the temperature of the exiting oxidized gases sufficiently so as to maintain the desired temperature level in the gases recirculating within the zones 10B, 10C and 10D. It will of course be borne in mind that the temperatures in the zones will in the preferred case be maintained at different levels and consequently different heat inputs normally be required. The temperature of the zones, as described above, is controlled through the operation of the dampers 64 in the branch ducts 40, 42 and 44, which are in turn controlled by the temperature sensitive controls 66. In order to reduce the temperature in a particular zone, its respective damper is closed down thereby shutting off some of the supply of effluent gases containing solvent fumes to the incinerator for that zone.

In this way, the temperature of each zone can be controlled accurately.

A proportion of the recirculating gases is removed as oven effluent from the zones 10C and 10D, continuously through their respective exhaust conduits 26 and 28, and is returned through the conduit 30 and reintroduced back into the zone 10B. At the same time, zone 10B is also receiving oxidized incinerator gases from its incinerator 56, as described above, and zone 10B will therefore normally be subjected to approximately three times the ventilation passing through zone 10C or 10D. This is desirable since there will be a greater volume of solvent vapours evaporated and removed in zone 10B, than in zones 10C and 10D.

The exhaust from zone 10B is removed through the exhaust conduit 24, and reintroduced into the gases recirculating in zone 10A. A certain proportion of fresh incoming air required by the system is introduced here so that the temperature input to the gases in zone 10A can be controlled and at the same time the overall percentage of solvent vapours in the gas mixture circulating in zone 10A is somewhat diluted, by the mixture of fresh air, without incinerating the gases passing into zone 10A. It will be understood that the heater 72 does not function as an incinerator but simply operates to maintain a desired stable temperature within the gases circulating in zone 10A. This is desireable since in the majority of cases zone 10A should be operated at a somewhat lower temperature than zones 10B, 10C and 10D. The ventilation passing through zone 10A will be the sum of the entire exhaust from zone 10B together with the fresh air input.

The entire exhaust from zone 10A is removed at the main oven exhaust 22a through duct 22 and passes into the plenum 36 where it is again available for recycling down the supply duct 38.

Throughout this operation, a varying proportion of the gases in the plenum 36 is continuously withdrawn through the bypass duct 92 and passed through the bypass incinerator 94. The oxidized gases are fed into the radiant heating unit 82. The gases will circulate through the duct portions 84, 88 and 86, and give up some of their heat to the heat exchange surfaces 90, which will then radiate heat directly onto the strip passing between them, from both sides.

Gases exiting from the radiant heating unit 82 will discharge into the main oven exhaust section 22a and mix with cooler gases entering the exhaust duct 22 and be returned to the plenum 36.

Throughout this operation a continuous fixed portion of gases is removed from the plenum 36 through the exhaust duct 46 and fed through the incinerator 48, and the heat recovery system 52 and out through the stack 50.

Preferably, the percentage of gases passed through the incinerator 48 and up the stack 50 will be kept as low as possible consistent with the volume of fresh air entering the system, and the volumes of solvent vapours and products of combustion evolved during operation.

It will be noted that the very high temperature incinerator gases, ie. gases at about 1,400° F., will only occur after passage through the incinerators 56, 58 and 60, and incinerators 94 and 48. In the zones 10B, 10C and 10D, as soon as the gases pass through the incinerators, they will enter their respective zones, mix with the recirculating gases and lose their excess heat. Consequently, when they are again drawn into the duct work, they will be at a considerably lower temperature. In the case of the gases discharged from the radiant heating unit 82, the gases will immediately be mixing with gases at a lower temperature in the oven exhaust section. Consequently, the problem of handling gases flowing through the system and duct work at very high temperatures is eliminated. In fact, the maximum normal operating temperature experienced throughout the main portions of the duct work, fans and the like, will not exceed 900° F. At these temperatures, conventional duct work materials and fan materials can be used without suffering damage.

During the steady state operation of the oven unit, the volumes of gases entering the individual zones and 10D will be more or less stable, or subject only to quite minor variations in response to operation of the various temperature controls.

Similarly, the volume of gases exiting to atmosphere, through the incinerator 48 and stack 50 will also be maintained at a stable percentage of the total oven effluent. This percentage may vary somewhat depending on the nature of the solvents and the oxygen requirements of the system. If the system can operate with a lower percentage of oxygen while still maintaining effective oxidation of the solvent vapours, then less fresh air is required and less exhaust gases will be vented to atmosphere.

As mentioned above, the oven is highly flexible in its operation, and can accept different types of materials and different types of coatings and solvents. In the case of some materials and solvents, the operation of the individual zone incinerators 56, 58 and 60, will consume a larger proportion of effluent and thus reduce the volume required to be handled by the bypass incinerator to a minimum.

In other cases the demand of the zone incinerators 56, 58 and 60 will be lower, and in these cases the bypass incinerator 94 will be regulated to consume a proportionally increased volume of the effluent so as to reduce the solvent vapour percentage and thus maintain the desired level throughout the system.

Thus, once a steady state operation is achieved in the zones 10B, 10C and 10D the volume of gases passing through the bypass incinerator 94 will be regulated to whatever level is necessary to consume the balance of the solvent vapours in the system. In this way, the bypass incinerator provides a wide range of flexibility in the overall operation of the entire oven system without the necessity for increasing the volumes of gases which are exhausted to atmosphere in a wasteful manner.

Figure 9:
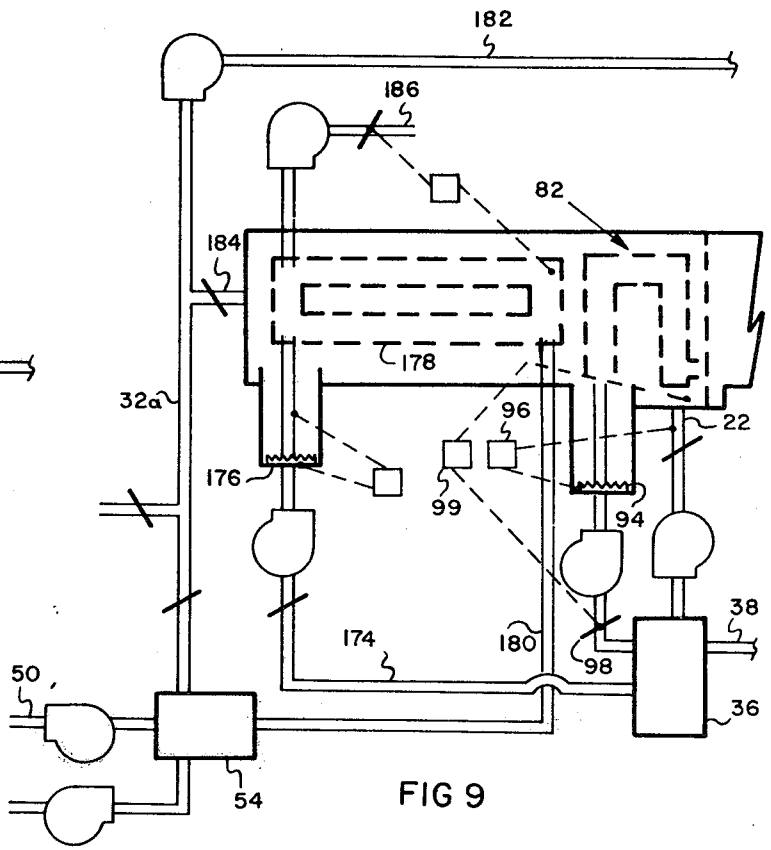

In some cases, it may be desireable to provide an alternate form of radiant heating unit, as is shown in FIG. 9.

In this embodiment, the zone 10A of the oven is modified to eliminate the convection heating of the workpiece, and the recirculating fans and duct work, and this is replaced by more extensive radiant heating throughout zone 10A. Thus zone 10A is shown having a fresh air branch air duct 32a which receives fresh air from any source as a coater room, fresh air or the like. The plenum 36 is connected with the zone 10A through the a gas input duct 174. The duct 174 supplies solvent laden gases from the plenum 36 to an incinerator 176 and gases from such incinerator 176 are supplied through radiant duct work 178 consisting essentially of upper and lower passages extending lengthwise along the zone 10A above and below the path of a strip or workpiece passing through the zone 10A. A return duct 180 communicates with the other end of the radiant duct work 178, and connects with the fresh air preheater 54 and then to the stack 50.

An effluent gas duct 182 receives effluent gases from zone 10B (not shown) and connects with the branch air duct 32a and provides a joint gas input 184 entering the zone 10A, to provide a gas mixture consisting of combined hot effluent gases, and cooler fresh air for ventilation of the oven 10A. This provides ventilating gas flow parallel to the workpiece having only a minimal heating effect.

Exhaust from the oven 10A is withdrawn through the exhaust conduit 22 and returned to the plenum 36.

Additional fresh air if required for the purposes of cooling the radiant duct work 178 may be introduced through a secondary fresh air intake 186.

As will be seen, the gases exiting from the incinerator 176 are first of all employed for radiant heating of the strip itself, through the radiant duct work 178, and are thereafter passed to the exhaust duct 180 and stack 50. Thus the incinerator 176 replaces the exhaust incinerator 48 of the embodiment of FIG. 5 so producing further economies in heat recovery.

The bypass incinerator 94 and radiant heating unit 82 remain unaffected and function as before.

During the start up condition of the oven, since there will be only a small percentage of solvent vapours in the incoming fresh air, or possibly none at all, the supplementary burners 70 will be turned up to a point where sufficient heat input is provided for each of the zones to provide a satisfactory cure or treatment of the workpiece and coating thereon. As the effluent content of the gases circulating in the zones builds up, then the heat input from the zone incinerators will become greater, and it will then be possible to turn the supplementary heaters down to their low fire condition.

In the event that the line is shut down for some reason either for a changeover from one colour or coating to another or for some other reason, then the quick cool venting system 100 will be put into operation whereby to admit fresh air directly into the system at the various points where the quick cool dampers are provided, thereby rapidly reducing the temperature of the gases in the various zones.

In this way, it is possible to effect a relatively rapid colour change for example by shutting down the line, operating the quick cool damper system, and then when the line is started up again the supplementary burners are put into action to rapidly increase the heat in the zones to their working temperature.

The foregoing description of the invention is given here by way of example only with reference to the drawings herein. It is not intended that the invention shall be limited to any of the specific features as described or shown, but comprehends all such variations as come within the scope of the appended claims.

What is claimed is:

1. A heat treatment oven apparatus for treating a workpiece carrying a coating containing a vapourizable solvent, said solvent being oxidizable to provide at least part of the heat input requirement for said oven, said apparatus comprising;

an oven having a plurality of oven zones, said workpiece being movable through said zones in sequence;

zone gas recirculation means having inlet means and outlet means for circulating gases in said zones continuously around such a workpiece within said zones whereby to entrain vapourized solvent;

gas exhaust means for said zones, for continuously removing a portion of the gaseous atmosphere containing untreated solvent vapours from such zones;

a downstream gas transferring duct connected with said gas exhaust of one of said zones, for transferring untreated solvent-carrying gases from said one of said zones in a downstream direction;

solvent incinerator means disposed essentially at a different one of said zones located downstream with reference to the direction of movement of said workpiece, said incinerator means being connected directly with said downstream gas transferring duct whereby to receive said solvent-carrying gases and incinerate them and oxidize solvent varpours contained in said gases prior to discharge of said gases into said downstream one of said zones, and, an incinerator outlet discharging said incinerated gases at said inlet means of said gas recirculation means of said downstream one of said zones at an elevated temperature with respect to gases circulating in said zone and with a reduced solvent vapour content, said discharged gases mixing with said lower temperature oven gases entering said gas recirculating means.

2. A heat treatment oven apparatus as claimed in claim 1 which additionally comprises a heat exchanger disposed within one of said oven zones and an incinerator for receiving and oxidizing gases containing solvent vapour from one of said zones and discharging such gases after oxidation thereof into said heat exchanger, said heat exchanger comprising surfaces disposed for radiating heat onto a workpiece passing through said oven apparatus.

3. A heat treatment oven apparatus as claimed in claim 2 and in which said heat exchanger is disposed in a first upstream one of said zones, receives gases containing solvent vapour from that same zone after incineration and discharges such gases into that same zone.

4. A heat treatment oven apparatus as claimed in claim 1 and which additionally comprises an upstream gas-transferring means connected between said gas exhaust of one of said zones and said gas input of an upstream one of said zones.

5. A heat treatment oven apparatus as claimed in claim 1 which comprises at least three said oven zones and in which said downstream gas-transferring means is adapted to transfer gases exhausted from said one of said zones to a plurality of downstream ones of said zones.

6. A heat treatment oven apparatus as claimed in claim 5 and in which a said incinerator is provided at each of said downstream ones of said zones for incinerating solvent vapour transferred to said zones by said gas-transferring means.

7. A heat treatment oven apparatus as claimed in claim 6 and which additionally comprises an upstream gas-transferring means connected between said gas exhaust of at least one of said zones and said gas input of an upstream one of said zones.

8. A heat treatment oven apparatus as claimed in claim 1 and which additionally comprises air intake means on a first upstream one of said zones.

9. A heat treatment oven apparatus as claimed in claim 1 and in which said incinerator has associated therewith a damper for controlling the flow of gases thereto automatically in response to the temperature of an associated one of said zones.

10. A heat treatment oven apparatus as claimed in claim 9 and in which said incinerator comprises a fuel supply controller automatically operable in response to the temperature of the exhaust from said incinerator and the gaseous atmosphere within a respective one of said zones.

11. A heat treatment oven apparatus as claimed in claim 1 and which additionally comprises an auxiliary heater for each of said zones and operable to heat the gases in respective ones of said zones.

12. A heat treatment oven apparatus as claimed in claim 1 and including air inlets for each of said zones and normally closed dampers controlling said air inlets and being operable to admit air to said zones for rapid ventilation thereof.

13. A heat treatment oven apparatus as claimed in claim 1 and which additionally comprises a gas discharge system for removing, incinerating and discharging a portion of the gases from said oven apparatus.

14. A heat treatment oven apparatus as claimed in claim 13 and in which said gas discharge system is adapted to receive gases from a first upstream one of said zones.

15. A heat treatment oven apparatus as claimed in claim 1 and in which said incinerator disposed essentially at said different one or ones of said zones is disposed so as to discharge incinerated gases into a respective one of said gas circulation means.

* * * * *